US005469788A

United States Patent [19]

Michalik

[11] Patent Number: 5,469,788

[45] Date of Patent: Nov. 28, 1995

[54] PAPER TRAIN INLET IN A LONGITUDINAL FOLD GATE

[75] Inventor: Horst B. Michalik, Höchberg, Germany

[73] Assignee: Koenig & Bauer Aktiengesellschaft, Wurzburg, Germany

[21] Appl. No.: 260,731

[22] Filed: Jun. 15, 1994

[30] Foreign Application Priority Data

Jun. 15, 1993 [DE] Germany ..... 43 19 806.6

[51] Int. Cl.[6] ..... B41F 13/56

[52] U.S. Cl. ..... 101/227; 493/363; 493/364; 493/365; 400/621.1

[58] Field of Search ..... 101/224, 226, 101/227; 400/621, 621.1, 621.2; 493/356, 360, 361, 363, 364, 365, 366, 397, 400, 401, 439, 446, 454

[56] References Cited

U.S. PATENT DOCUMENTS

| | | | |
|---|---|---|---|
| 934,368 | 9/1909 | Stewart | 493/365 |
| 1,517,582 | 12/1924 | Rahr | 493/363 |
| 1,580,635 | 4/1926 | Barber | 101/224 |
| 1,690,288 | 6/1927 | Gearing . | |
| 1,739,328 | 12/1929 | Roesen | 493/360 |
| 2,334,674 | 11/1943 | Howey . | |
| 2,506,053 | 5/1950 | Zuckerman . | |
| 2,766,039 | 10/1956 | Matthews | 493/361 |
| 3,125,335 | 3/1964 | Becker | 101/227 |
| 3,608,889 | 9/1971 | Woesner et al. | 493/360 |
| 4,969,862 | 1/1990 | Ehlsheid | 493/360 |
| 5,052,296 | 10/1991 | Shiba | 101/227 |
| 5,171,203 | 12/1992 | Bullinger | 493/360 |

FOREIGN PATENT DOCUMENTS

| | | | |
|---|---|---|---|
| 542609 | 6/1957 | Canada | 101/227 |
| 2304473 | 11/1976 | France | 101/227 |
| 652089 | 10/1937 | Germany . | |
| 668877 | 11/1938 | Germany . | |
| 942143 | 3/1956 | Germany | 493/360 |
| 704973 | 11/1973 | Germany . | |
| 3347719 | 7/1985 | Germany | 493/397 |
| 3537018 | 4/1986 | Germany . | |
| 3347715 | 8/1988 | Germany . | |
| 4137818 | 5/1993 | Germany . | |
| 57-38265 | 3/1982 | Japan . | |
| 8302442 | 7/1983 | WIPO | 493/446 |

*Primary Examiner*—Eugene H. Eickholt
*Attorney, Agent, or Firm*—Jones, Tullar & Cooper

[57] ABSTRACT

A paper train inlet in a longitudinal fold gate utilizes an upstream paper guide cylinder and a downstream paper guide cylinder, which is situated adjacent to the gate, to guide superimposed paper webs to the longitudinal fold gate. At least one traction cylinder group is located between the upstream or remote paper guide cylinder and the downstream or adjacent paper guide cylinder. The paper train inlet provides a slip-free paper train transport by use of a traction cylinder drive mechanism of low structural height.

11 Claims, 1 Drawing Sheet

PAPER TRAIN INLET IN A LONGITUDINAL FOLD GATE

FIELD OF THE INVENTION

The present invention is directed generally to a paper train inlet in a longitudinal fold gate. More particularly, the present invention is directed to a paper train inlet in a longitudinal fold gate of a web-fed rotary printing press. Most specifically, the present invention is directed to a paper train inlet in a longitudinal fold gate which employs spaced paper guide cylinders and at least one traction cylinder group in the track of the paper web train to the longitudinal fold gate. The two spaced paper guide cylinders engage opposite sides of the paper train. The traction cylinder group or groups are placed intermediate the two paper guide cylinders. The utilization of the paper guide cylinders and traction cylinder groups in the track or train of paper web travel properly guides the paper web to the longitudinal folding gate.

DESCRIPTION OF THE PRIOR ART

In the production of folded printed products from a web of paper in a web-fed rotary printing press, after the paper web has been printed, it is typically longitudinally cut or slit and is then fed through a longitudinal fold gate to a longitudinal folder. The longitudinal folder or folders place first longitudinally extending folds in the printed web.

In one prior art device, as is shown in German Patent Publication DE 3347 715 C2, a traction cylinder is positioned generally above a longitudinal fold gate. This traction cylinder cooperates with a pressure roller to tensionally stress the several paper webs, which are disposed one on top of the other, and which pass between the cooperating traction cylinder and the pressure roller. In this prior art device, the cylinder group formed of the traction cylinder and the pressure roller is situated in a plane between a guide roller and an inclined surface of the longitudinal folding gate in such a way that the angle of wrap of the paper webs passing through this cylinder group is essentially zero. Since the wrap angle of the superimposed paper webs about the cylinder group is almost zero, there are no frictional forces which will occur between the paper webs which are placed on top of each other.

The traction cylinder group which is disclosed in the aboveidentified German Patent Publication has a limitation since the entry of the superimposed paper webs into the longitudinal folding gate must take place in a plane which is aligned with the inclination of the folding gate. This must occur in order to assure a virtually wrap-free passage of the paper webs through the previously described cylinder group. An other than a wrap-free pass through would be apt to generate significant frictional forces between the superimposed paper webs.

The requirement that the path of travel of the paper train through the cylinder group be with an almost zero wrap angle and thus be generally on the same plane as that of the longitudinal folding gate often results in an increased space requirement. This increased space requirement is quite apt to increase the structural height of the superstructure of the folding gate. Such an increase in superstructure height is clearly not desirable and often cannot be accomplished in a web-fed rotary printing press. It will thus be apparent that a need exists for a paper train transport which overcomes the limitations of the prior art. The paper train inlet in a longitudinal fold gate in accordance with the present invention provides such a device and is a significant improvement over the prior art.

SUMMARY OF THE INVENTION

It is an object of the present invention to provide a paper train inlet in a longitudinal fold gate.

Another object of the present invention is to provide a paper train inlet in a longitudinal fold gate of a web-fed rotary printing press.

A further object of the present invention is to provide a paper train inlet in a longitudinal fold gate which utilizes spaced paper guide cylinders and at least one intermediate traction cylinder group.

Yet another object of the present invention is to provide a slip-proof paper train transport.

Still a further object of the present invention is to provide a paper train transport using a traction cylinder group of lesser structural height.

As will be discussed in greater detail in the description of the preferred embodiments which is presented subsequently the paper train inlet in a longitudinal fold gate in accordance with the present invention utilizes spaced upstream and downstream, in the direction of paper web travel, paper guide cylinders. At least one traction cylinder group is located between the two paper guide cylinders. The plural layer paper web assembly, which is to be fed to the longitudinal folder through its inlet gate, is passed under the upstream or remote paper guide cylinder, and over the downstream or adjacent paper guide cylinder with the downstream paper guide cylinder being adjacent the longitudinal folding gate. The traction cylinder group or groups positioned intermediate the two paper guide cylinders utilize a traction cylinder on a first side of the paper webs and a group of cooperating traction rollers on a second side of the web. The traction cylinder group or groups insure that there is no slippage between the superimposed paper webs as a result of their passages around the paper guide cylinders.

The slip-proof paper train transport of the present invention has several significant advantages. The angle of wrap of the paper webs on the paper guide or gate inlet cylinders can be variable as opposed to near zero as was required in the prior art devices. There is accordingly no additional space requirement for placement of the traction cylinder group or groups of the present invention. Because of the disposition of the traction cylinder group of the present invention in an area without displacement of the superimposed paper webs, a transfer of the traction forces from the traction cylinder group or groups to the paper webs takes place in a manner which is almost free from slippage and which therefore causes very little wear. If a plurality of traction cylinder groups are placed intermediate the upstream and downstream spaced paper guide cylinders, it is possible to convey paper trains having a large number of superimposed paper webs in a particularly advantageous manner.

The paper train inlet or transport in a longitudinal fold gate in accordance with the present invention overcomes the limitations of the prior art devices. It is a substantial advance in the art.

BRIEF DESCRIPTION OF THE DRAWINGS

While the novel features of the paper train inlet in a longitudinal fold gate are set forth with particularity in the appended claims, a full and complete understanding of the invention may be had by referring to the detailed description of the preferred embodiment which is set forth subsequently, and as illustrated in the accompanying drawings, in which:

DESCRIPTION OF THE PREFERRED EMBODIMENTS

Figure 1:
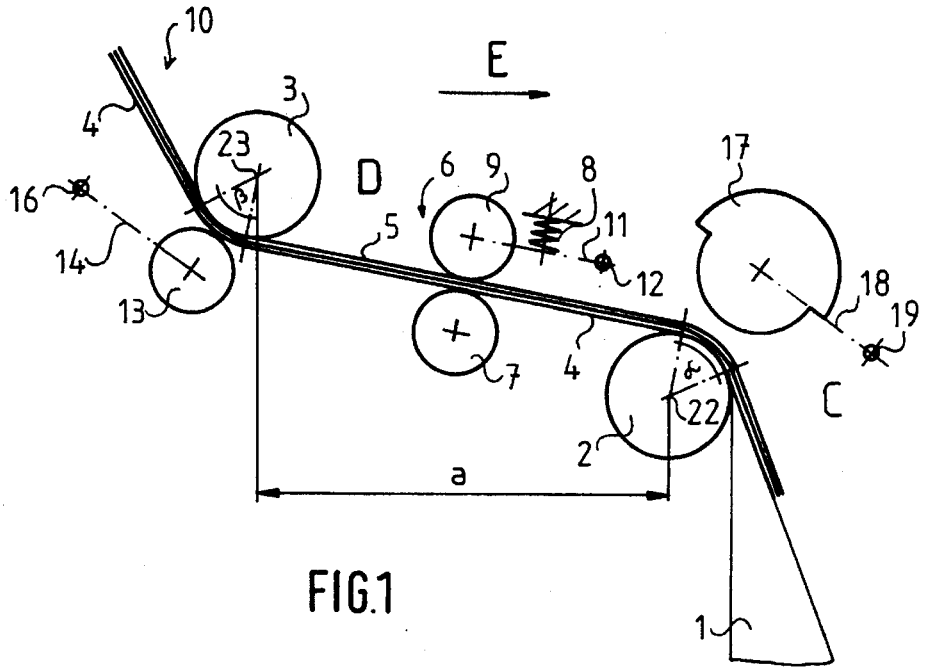
FIG. 1 is a schematic side elevation view of a first preferred embodiment of a paper train inlet in accordance with the present invention.

Referring initially to FIG. 1, there may be seen a first preferred embodiment of a paper train inlet in a longitudinal fold gate in accordance with the present invention. A longitudinal folding gate is depicted somewhat schematically at 1. It will be understood that this longitudinal folding gate 1 is generally conventional in structure and operation. It functions to form a longitudinal fold; i.e., a fold extending in the direction of web travel, in a paper web or web section. A gate inlet cylinder or downstream paper guide cylinder 2 is situated close to the longitudinal folding gate 1 while a remote or upstream paper guide cylinder 3 is located away from or upstream in the direction of paper web travel, from the longitudinal folding gate 1. The adjacent or downstream paper guide cylinder 2 and the remote or upstream paper guide cylinder 3 are separated from each other by a distance "a" which is the distance between the two axes of rotation 22 and 23 of cylinders 2 and 3, respectively. These two paper guide cylinders 2 and 3 are supported for rotation between spaced side frames of the paper web-fed rotary printing machine with these side frames not being specifically shown.

A number of superimposed paper webs, such as representative webs 4 and 5, are guided around the two paper guide cylinders 2 and 3. As may be seen in FIG. 1, the remote or upstream paper guide cylinder 3 is placed above the paper webs 4 and 5 while the downstream or adjacent paper guide cylinder 2 is placed below the paper webs 4 and 5. The paper webs have a wrap angle $\alpha$ with respect to the surface of paper guide cylinder 2 and a wrap angle $\beta$ with respect to the paper guide cylinder 3. It is preferable that these two wrap angles are generally the same and that they be in the range of 0° to 120°. They can deviate from each other by not more than ±5° in order to compensate for a displacement of the paper webs 4 and 5 with respect to each other.

A first traction cylinder group generally at 6, which consists of a traction cylinder 7 and a plurality of traction rollers 9, is, as may be seen in FIG. 1, positioned in contact with the paper webs 4 and 5, intermediate the two paper guide cylinders 2 and 3. The traction cylinder 7 is rotatably supported between the press's side frames. It can be divided in its axial direction into four quarter-web width sections. The traction rollers are supported by support arms 11 for pivotal motion about a support spindle 12 which is placed between the side frames. A plurality of springs 8 are used to press the traction rollers 9 against the traction cylinder 7. In the preferred embodiment, each quarter width section of the traction cylinder 7 cooperates with two traction rollers 9. It will be understood that the traction rollers 9 are positioned so as to contact print-free strips on the paper web 5.

The paper guide cylinders 2 and 3, as well as the traction cylinder 7 and the several individual traction rollers 9 can all be driven at the same circumferential speed. Any suitable drive source, such as differential gearing, separate gear drives or the like can be used to accomplish this. The distance "a" between the axes of rotation 22 and 23 of the two spaced paper guide cylinders 2 and 3 should be in the range of three to five times the diameter of the traction cylinder 7.

A circular paper web cutter 13, which is provided with its own drive mechanism, is disposed beneath the upstream or remote paper guide cylinder 3. This paper web cutter 13 is supported by spaced support arms 14 that are pivotable about spaced bearings 16 which are secured to the side frames of the printing press. The circular cutter 13 is used to cut the superimposed paper webs 4 and 5 in the longitudinal direction of paper web travel along the paper train and divides the paper webs into longitudinally separate paper web segments. The circular cutter cuts in cooperation with, and bears against a lower surface of the upstream or remote paper guide cylinder 3.

It is also possible to position a so-called skip cutter or intermittent cutter 17 above the downstream or adjacent paper guide cylinder 2. This skip cutter 17 is supported by spaced arms 18 for pivotal motion about its own pivot points or bearings 19 which are also secured between the side frames of the printing press assembly. The skip cutter 17 has its own drive mechanism (which is not specifically shown) and is used to make alternating, longitudinally extending slits or cuts in the paper webs 4 and 5. These alternating slits or cuts are often needed, for example for the production of tabloids or inserts for newspapers. The skip cutter 17 is positioned generally above the downstream or adjacent paper guide cylinder 2 which is positioned just before the longitudinal folding gate 1.

Figure 2:
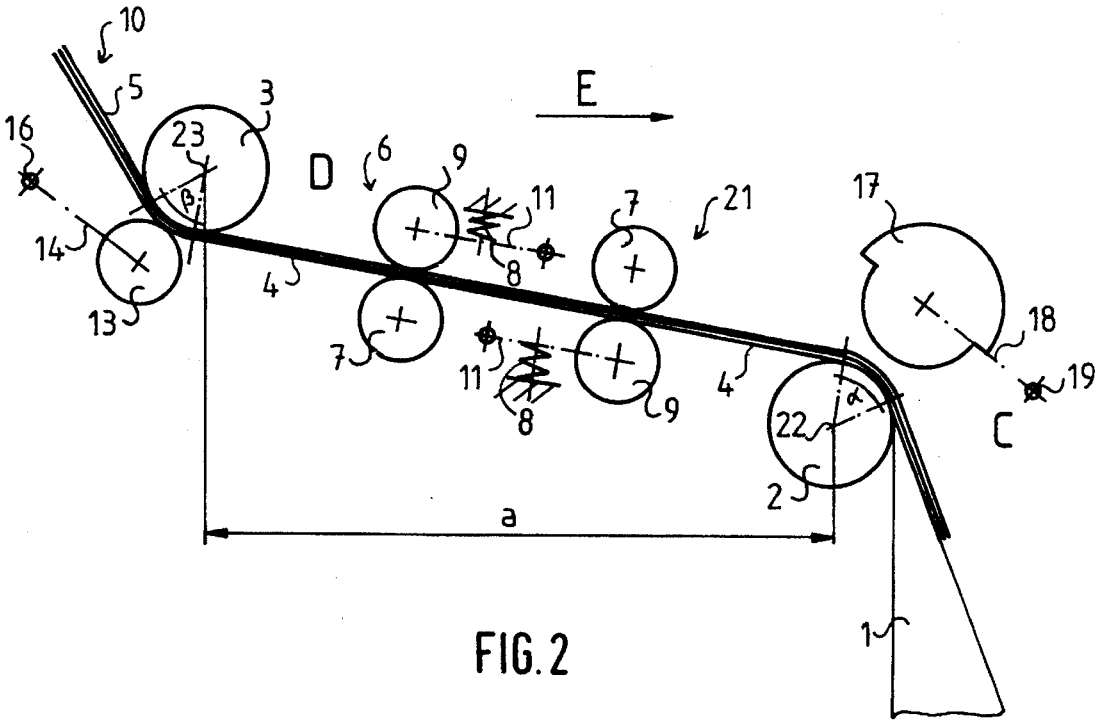
FIG. 2 is a schematic side elevation view of a second preferred embodiment of the present invention.

Turning now to FIG. 2, there may be seen a second preferred embodiment of a paper train inlet in a longitudinal fold gate in accordance with the present invention. In this second embodiment, like numerals are used for elements which are the same as that shown in the first embodiment. In this second preferred embodiment, there are provided a first or upstream traction cylinder group 6, which is the same as its counterpart in the first preferred embodiment, and a second or downstream traction cylinder group, generally at 21. As may be seen in FIG. 2, the upstream or remote traction cylinder group 6 utilizes a traction cylinder 7 positioned beneath the webs 4 and 5, and a plurality of traction rollers 9 above the paper webs 4 and 5. The downstream or adjacent traction cylinder group 21 is structured as the inverse of the upstream traction cylinder group 6. Thus the traction cylinder 7, which may be divided axially into four sections, is placed above the superimposed paper webs 4 and 5. The traction rollers 9 of the downstream traction cylinder group 21 are placed beneath the paper webs 4 and 5. These traction rollers 9 are pivotably supported by spaced arms 11 supported by bearings 12 and biased into contact with the paper web 4 by suitable springs 8.

As can be seen in FIG. 2, and as discussed above, the traction cylinder 7 in the upstream or remote traction cylinder group 6 is placed beneath the webs 4 and 5 while the remote or upstream paper guide cylinder 3 contacts the upper surface of the upper one of the superimposed paper webs 4 and 5. The traction cylinder 8 in the downstream or adjacent traction cylinder group 21 contacts the upper surface of the upper web 5 whereas the downstream or remote paper guide cylinder 2 is situated beneath the superimposed paper webs 4 and 5. This mirror invented arrangement of the two traction cylinder groups 6 and 21 is very effective for compensating for any differences which may occur when the traction rollers 9 are placed against the paper webs 4 and 5. In this second preferred embodiment of the invention, the distance "a" between the upstream or remote and downstream or adjacent paper guide cylinders 3 and 2 should be in the range of four to eight times the diameter or one of the traction cylinders 7. A multitude of paper webs 4 and 5, placed in a superimposed relationship, can be conveyed to the longitudinal folding gate 1 in a particularly advantageous manner by the double arrangement of traction cylinder groups 6 and 21 in accordance with the present invention.

The two paper guide cylinders 2 and 3, in accordance with either of the preferred embodiments of the present invention, can be located on a single plane C, or can be situated on two different planes C and D which correspond to the respective values of their angles of wrap α and β. When viewed in the direction of movement E of the paper train, the upper paper web 5 first contacts a portion of the surface of the upstream or remote paper guide cylinder 3 with the lower paper web 4 contacting the upper paper web 5. In the downstream or adjacent paper guide cylinder 2, which is adjacent the longitudinal folding gate 1, the lower paper web 4 rests on the surface of the paper guide cylinder 2 while the upper paper web 5 rests on the lower web 4. It is also possible, in accordance with the present invention to direct the paper web train 10, which consists of the paper webs 4 and 5 in such a manner that exclusively the paper web 4 rests on the jacket surfaces of the two paper guide cylinders 2 and 3. This can be accomplished by directing the paper train 10, as shown in FIGS. 1 and 2 above the axes of rotation of the paper guide cylinders 2 and 3. This will require the addition of a third paper guide cylinder (not specifically shown in the drawings) ahead of, in the direction of paper web travel, the upstream or remote paper guide cylinder 3. The paper web train 10 would be caused to pass around this third paper guide cylinder.

While preferred embodiments of a paper train inlet in a longitudinal fold gate for a web-fed rotary printing press have been set forth fully and completely hereinabove, it will be apparent to one of skill in the art that a number of changes in, for example, the overall size of the cylinders and rollers, the type of drives for the circular cutter and the strip cutter, and the types of support arms and the springs being used could be made without departing from the true spirit and scope of the present invention which is accordingly to be limited only by the following claims.

What is claimed is:

1. A paper train inlet in a longitudinal fold gate in a track of a paper web train of a web-fed rotary printing press, said paper train inlet comprising:

a first driven paper guide cylinder positioned adjacent to, and before, in a direction of paper web travel, a longitudinal fold gate and engageable with a surface of a paper web train;

a second driven paper guide cylinder positioned remote from, and before, in a direction of paper web travel, the longitudinal fold gate and engageable with a surface of the paper web train, said first and second paper guide cylinders being spaced from each other along said direction of paper web travel at a distance "a" and acting on the paper web train; and at least a first traction cylinder group engageable with the paper web train and positioned between said first and second paper guide cylinders, the paper web train partially wrapping around said first paper guide cylinder at a first wrap angle α and partially wrapping around said second paper guide cylinder at a second wrap angle β.

2. The paper train inlet of claim 1 wherein said at least first traction cylinder group includes a first traction cylinder and several first traction rollers which are pressed against said traction cylinder.

3. The paper train inlet of claim 1 wherein said first and second wrap angles are approximately the same.

4. The paper train inlet of claim 2 wherein said first traction cylinder is divided axially into four quarter width sections and further wherein one of said first traction rollers is associated with each end of each of said traction cylinder quarter width sections.

5. The paper train inlet of claim 2 wherein said first and second paper guide cylinders and said traction rollers are driven at the same circumferential speed.

6. The paper train inlet of claim 1 further including a circular cutter associated with one of said first and second paper guide cylinders.

7. The paper train inlet of claim 6 further including a skip cutter associated with the other of said first and second paper guide cylinders.

8. The paper train inlet of claim 1 further including a second traction cylinder group positioned between said first and second paper guide cylinders, each of said first and second traction cylinder groups having a traction cylinder and several traction rollers, said traction rollers in said first and second traction cylinder groups being on opposite sides of the paper web train.

9. A paper train inlet in a longitudinal fold gate in a track of a paper web train of a web-fed rotary printing press, said paper train inlet comprising:

a first driven paper guide cylinder positioned adjacent, in a direction of paper web travel, to a longitudinal fold gate;

a second driven paper guide cylinder positioned remote, in a direction of paper web travel, from the longitudinal fold gate, said first and second paper guide cylinders being spaced from each other at a distance "a" and acting on the paper web train; and at least a first traction cylinder group positioned between said first and second paper guide cylinders, said at least first traction cylinder group including a first traction cylinder and several first traction rollers which are pressed against said traction cylinder, the paper web train partially wrapping around said first paper guide cylinder at a first wrap angle α and partially wrapping around said second paper guide cylinder at a second wrap angle β.

10. The paper train inlet of claim 9 wherein said first traction cylinder is divided axially into four quarter width sections and further wherein one of said first traction rollers is associated with each end of each of said traction cylinder quarter width sections.

11. The paper train inlet of claim 9 further including a second traction cylinder group positioned between said first and second paper guide cylinders, each of said first and second traction cylinder groups having a traction cylinder and several traction rollers, said traction rollers in said first and second traction cylinder groups being on opposite sides of the paper web train.

* * * * *